US005309940A

United States Patent [19]

Delabie et al.

[11] Patent Number: 5,309,940

[45] Date of Patent: May 10, 1994

[54] FAUCET FOR A WASH BASIN OR OTHER SANITARY EQUIPMENT WHICH OPENS AND CLOSES AUTOMATICALLY

[75] Inventors: Gerard Delabie, Saint-Blimont; Marcel Normand, Arrest, both of France

[73] Assignee: Delabie S.A., France

[21] Appl. No.: 967,657

[22] Filed: Oct. 28, 1992

[30] Foreign Application Priority Data

Oct. 31, 1991 [FR] France ..... 91 13656

[51] Int. Cl.[5] ..... F16K 11/076; F16K 31/06

[52] U.S. Cl. ..... 137/607; 137/625.41; 251/129.04

[58] Field of Search ..... 137/607, 625.41; 251/129.04

[56] References Cited

U.S. PATENT DOCUMENTS

| | | | |
|---|---|---|---|
| 4,681,141 | 7/1987 | Wang | 137/607 |
| 4,826,129 | 5/1989 | Fong et al. | 251/129.04 |
| 4,928,732 | 5/1990 | Hu | 251/129.04 X |
| 4,955,535 | 9/1990 | Tsutsui et al. | 251/129.04 X |
| 5,050,641 | 9/1991 | Shwu-Fen | 137/607 |
| 5,080,324 | 1/1992 | Chi | 251/129.04 |
| 5,243,717 | 9/1993 | Yasuo | 251/129.04 |

FOREIGN PATENT DOCUMENTS

| | | |
|---|---|---|
| 0446953 | 9/1991 | European Pat. Off. . |
| 2629794 | 1/1978 | Fed. Rep. of Germany . |
| 3445700 | 6/1986 | Fed. Rep. of Germany . |
| 1494301 | 9/1967 | France . |

*Primary Examiner*—Stephen M. Hepperle
*Attorney, Agent, or Firm*—Lerner, David, Littenberg, Krumholz & Mentlik

[57] ABSTRACT

Device which can be fitted to a faucet in order to trigger the automatic issuance of water.

Said device is integrally joined to the operating unit of said faucet and consists of a cylindrical body (3) housing a detection cell (5), said cylindrical body being placed in a cavity (41) in said operating unit and being integrally joined to the control unit (6) of said faucet, with said faucet including a window (61) positioned facing said cylindrical body (3) for the passage of the rays (62) which are necessary for the operation of said detection cell (5).

7 Claims, 6 Drawing Sheets

FAUCET FOR A WASH BASIN OR OTHER SANITARY EQUIPMENT WHICH OPENS AND CLOSES AUTOMATICALLY

The present invention relates to a faucet for a wash basin or other sanitary equipment which opens and closes automatically, and more particularly relates to the operating unit of such a faucet.

Faucets are already known which have an infrared or ultrasonic detection cell suitable for detecting the presence of the hands of a user and for transmitting said information to an electronic control module which is programmed to activate one or two solenoid valves.

Some of such faucets include a detection cell located on the body of the faucet, either in proximity to the water-outlet or at the base of the faucet. However, such devices generally have the disadvantage that an uninformed user does not immediately understand the method of operation, particularly in the case of a simple faucet without a mixing battery.

The present invention is intended to remedy the abovementioned disadvantages by providing a device which is adaptable to an automatically operating faucet, whose embodiment is simple, and whose essential characteristic resides in the fact that the detection cell is incorporated into its operating unit, the front of which includes a window for the passage of the rays which are necessary for the operation of said cell, such as for example infra-red rays.

For this purpose, and in accordance with the invention, the control handle or button is extended by a housing which is adapted so as to contain a cylindrical body which encloses said detection cell.

In accordance with a first embodiment of the invention, adapted for a simple non-mixing faucet, said cylindrical body includes at its inner extremity a cut-out which creates an opening for the passage of the electrical cable which connects said detection cell to the control housing of a solenoid valve which ensures the issuance of the water.

In said embodiment the operating unit has no real utility as such, inasmuch as the issuance of the water occurs automatically as soon a user advances his hands in the direction of said operating unit, said unit serving essentially to elicit said gesture by said user.

In accordance with a second embodiment of the invention, adapted for a mixing faucet, said cylindrical body is extended coaxially by a mixing cam of a known type to which said cylindrical body is joined integrally and which is protected within an appropriate housing which extends the housing of said cylindrical body.

In said second embodiment, said cylindrical body is advantageously integrally joined to said mixing cam by means of an angular part whose cross-section is in the form of an arc of a circle and whose base extends said cylindrical body, with said assembly as a whole being mobile in terms of rotation around its axis.

In said case, screws positioned judiciously around said angular part serve as stops for said angular part, thereby making it possible to limit in both directions the rotation of said mixing cam, with said screws advantageously being able to serve to hold said mixing cam in translation and to extend so as to penetrate into said detection cell in such a way as to immobilize said detection cell rotatively and thus to prevent wear on the power-supply cable of said detection cell.

In said second embodiment, a solenoid valve is provided on each of the water inlet conduits, with the control of said solenoid valves likewise being provided by said detection cell, with said operating unit serving only to adjust the temperature of said mixture of hot and cold water.

The advantages and characteristics of the present invention will become clearer through the following description, which refers to the attached drawing on which various non-limitative embodiments of the invention are represented.

Figure 2:
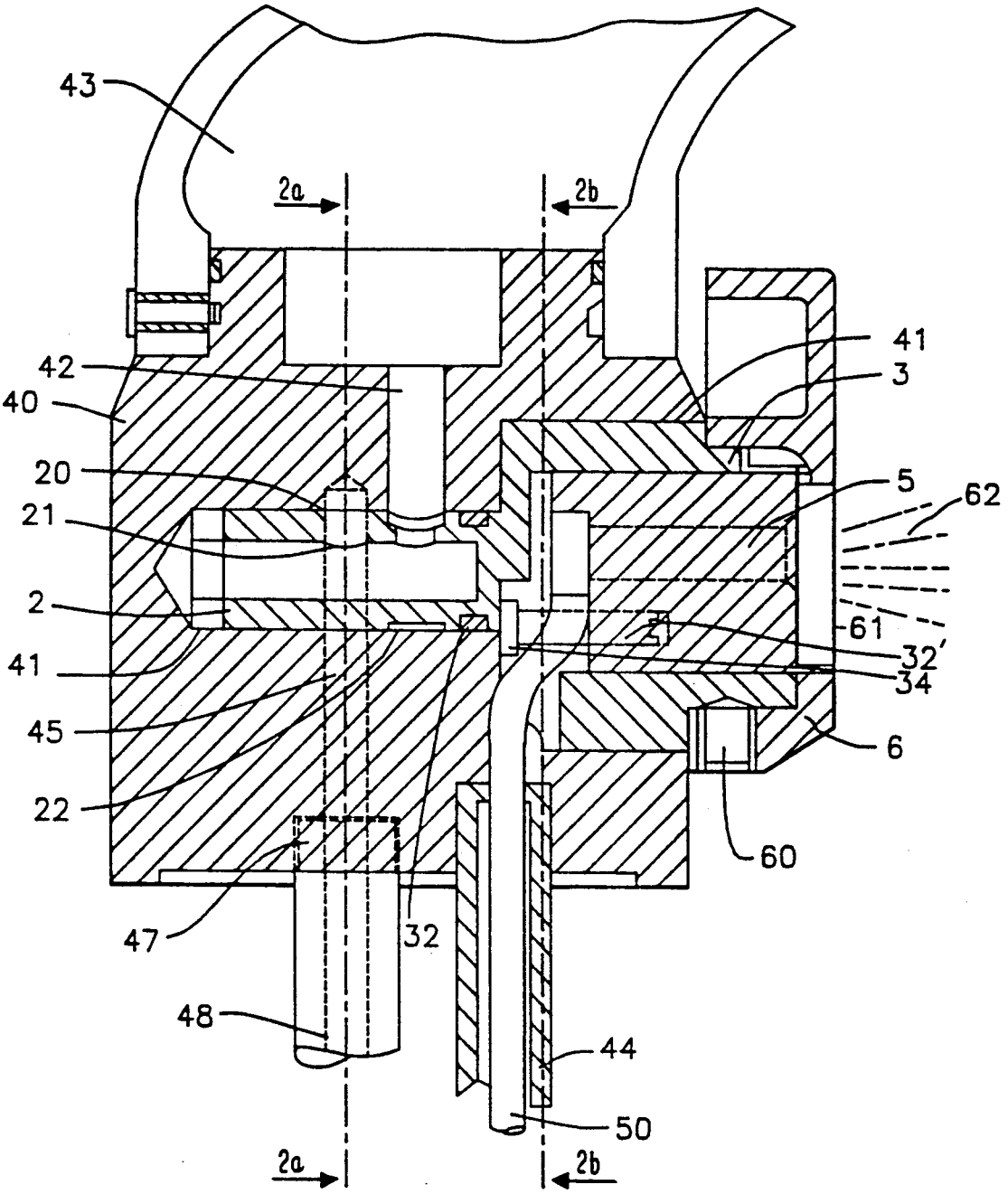
FIG. 2 represents a vertical sectional view of a second embodiment of the invention.
Figure 2A:
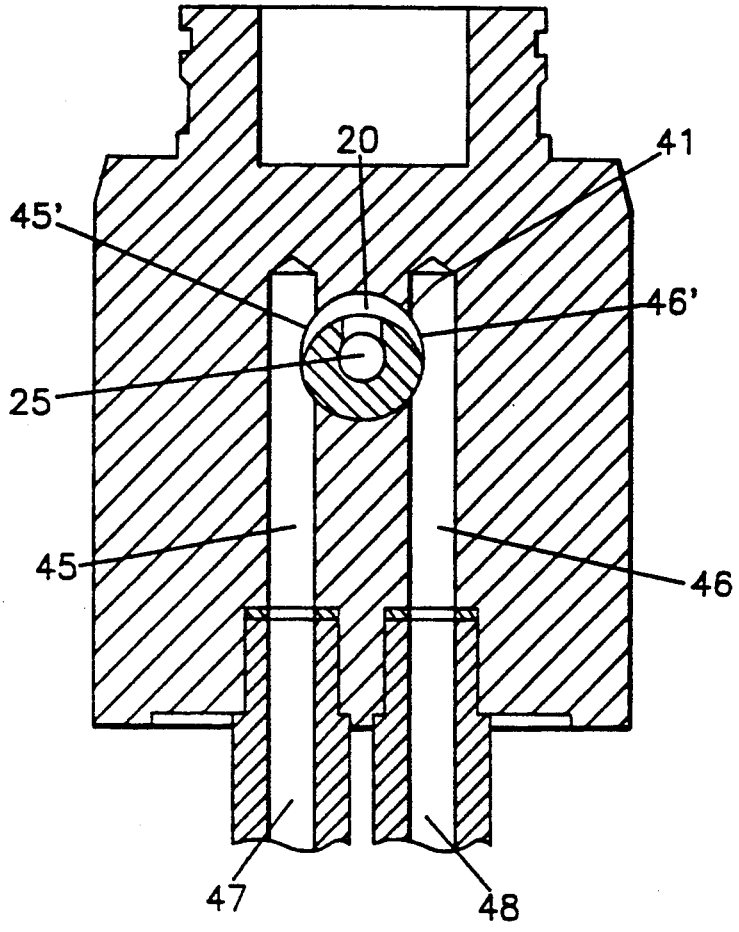

FIG. 2*a* represents a sectional view along the 2*a*—2*a* axis in FIG. 2.

Figure 2B:
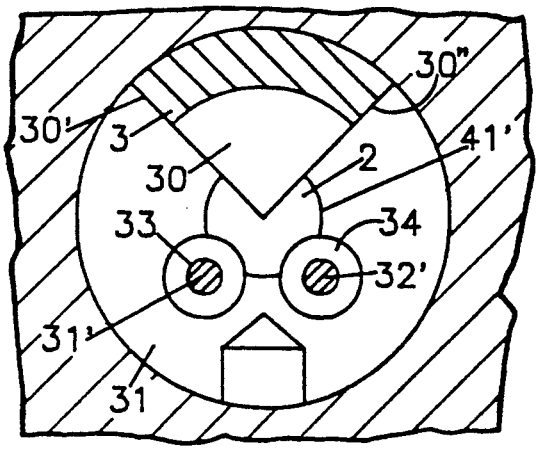

FIG. 2*b* represents a sectional view along the 2*b*—2*b* axis in FIG. 2.

Figure 3:
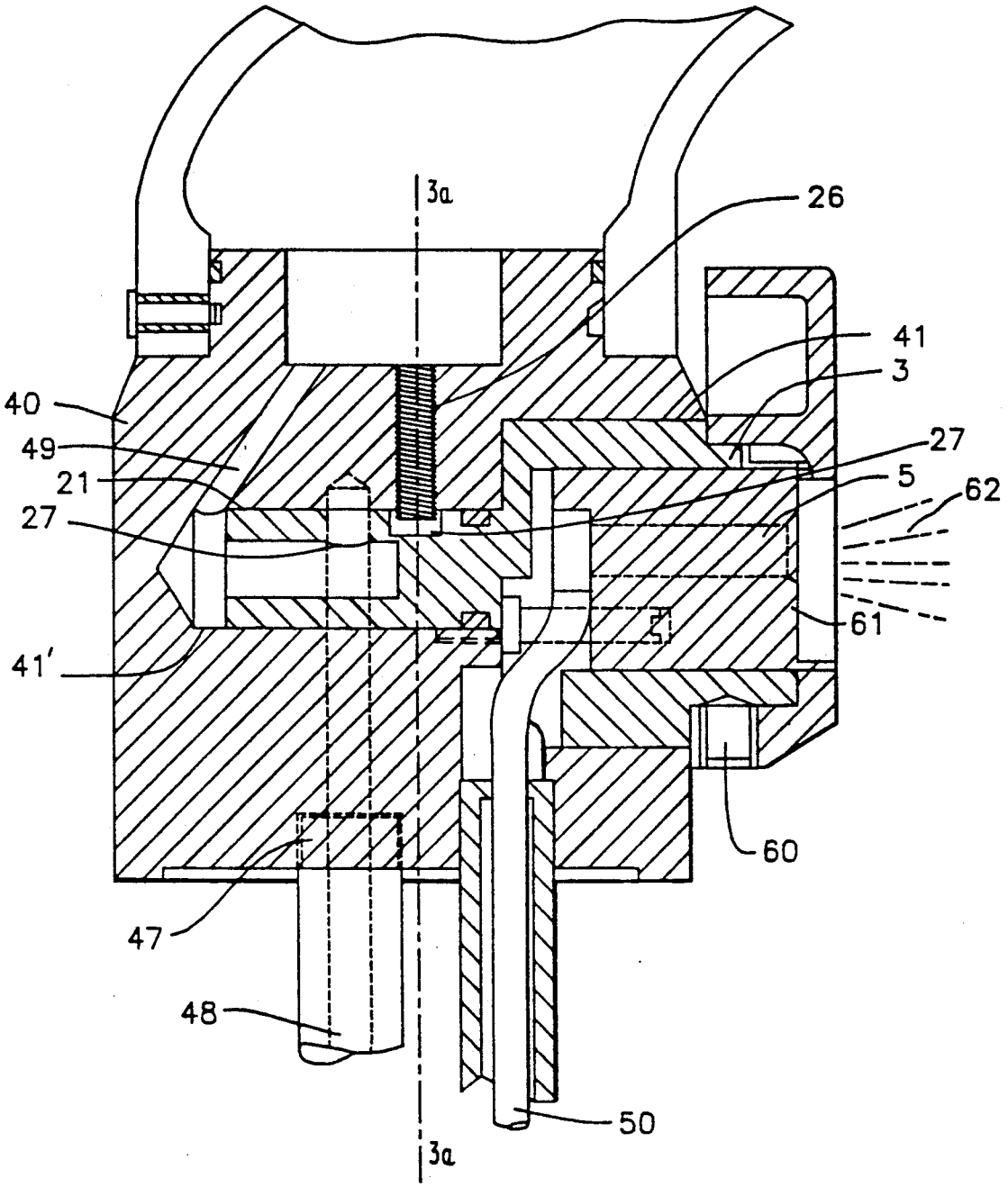

FIG. 3 represents a vertical sectional view of a third embodiment of the invention.

Figure 3A:
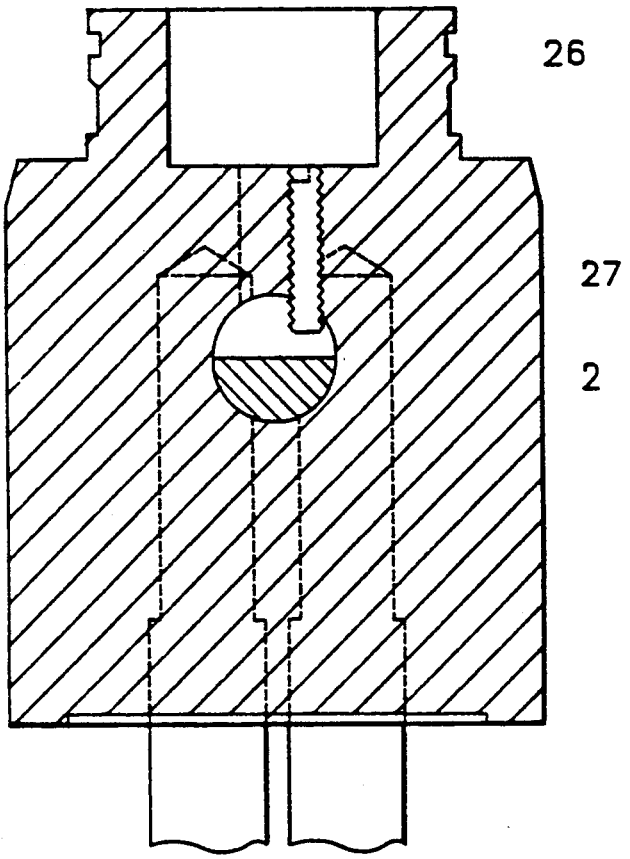

FIG. 3*a* represents a sectional view along the 3*a*—3*a* axis in FIG. 3.

Figure 4A:
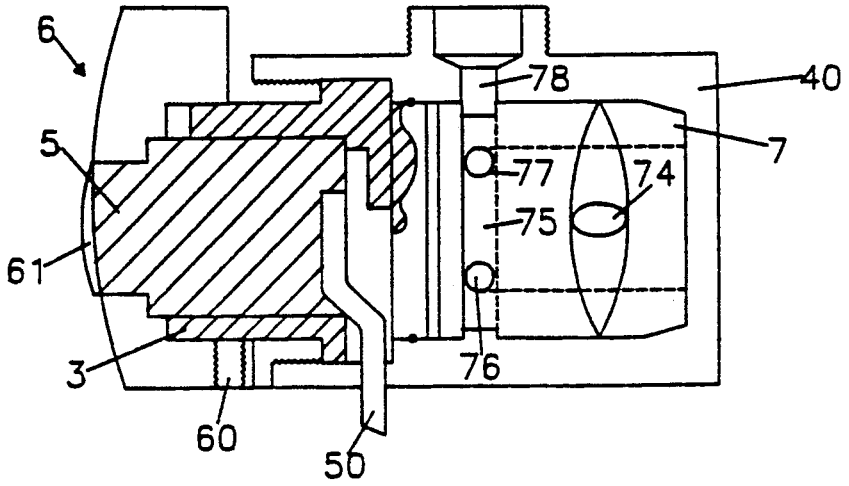

FIG. 4*a* represents a lateral view, with a partial section, of a fourth embodiment of the invention.

Figure 4B:
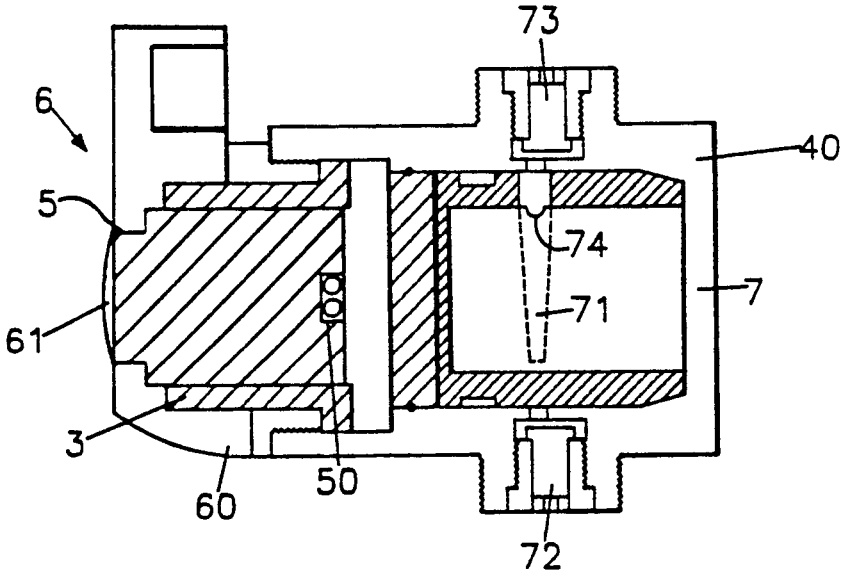

FIG. 4*b* represents a view from above, with a partial section, of said same embodiment of the invention.

Figure 1:
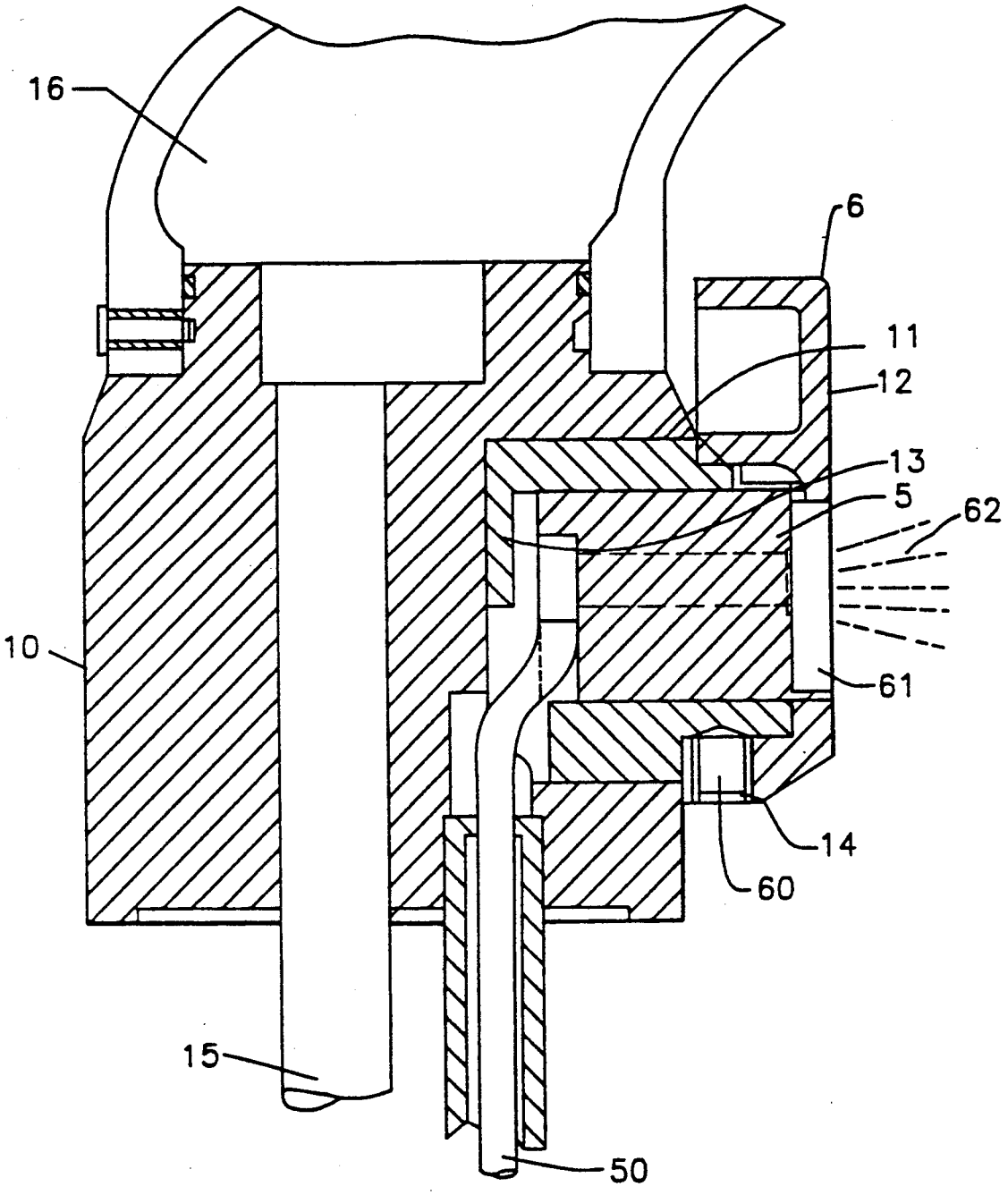
FIG. 1 represents a vertical sectional view of a first embodiment of the invention.

With reference to FIG. 1, this figure shows the dummy operating unit of a faucet in accordance with the invention without a mixing battery.

The body (10) of said faucet includes a cylindrical perforation (11) into which is inserted a cylindrical body (12) which houses a detection cell (5).

Said cylindrical body (12) is extended, at its inner extremity, by a part (13) which includes a space (14) between said body (10) of said faucet and the base of said cylindrical body (12) for the passage of a power-supply cable (50) which connects said cell (5) to the control housing of a solenoid valve (not shown) placed upstream on a water-inlet conduit (15) which opens downstream into an outflow tank (16).

A so-called "control" handle (6) is integrally joined to said cylindrical body (12) by means of a screw (60), with said handle including a window (61) for the passage of rays (62) emitted by said detection cell (5).

It is evident that in said embodiment said so-called "control" handle (6) has no actual utility as such, serving only to elicit the gesture by the user which will trigger the issuance of the water.

With reference now to FIG. 2, this figure shows the operating unit for a mixing faucet in accordance with the invention.

The body (40) of said mixing battery includes a cylindrical cavity (41) whose diameter is adapted to the diameter of the cylindrical body (3) which is inserted therein, extended by a cavity (41') whose diameter is adapted to the diameter of a mixing cam (2).

A groove (22) in said cam (2) communicates with a vertical channel (42) which starts in said cylindrical cavity (41') and opens into an outflow tank (43).

A detection cell with infra-red rays (5) is positioned within said cylindrical body (3) and is connected, by means of a power-supply cable (50) which passes through a connection sleeve (44), to a control housing for two solenoid valves (not shown).

With reference also to FIG. 2*a*, it can be seen that said cylindrical cavity (41') partially traverses, essentially at its extremity, two vertical dummy channels (45) and (46), which are connected to water-inlet conduits (47) and (48), for hot and cold water, respectively.

A partial eccentric groove (20) in said mixing cam (2) defines openings (45') and (46') in said channels (45) and (46).

With reference also to FIG. 2*b*, it can be seen that said mixing cam (2) is held in said cylindrical cavity (41') by means of two screws (31) and (32) which are screwed into said body (40) below said cylindrical cavity (41') on either side of a vertical line which passes through the axis of said cam (2), with each of said screws including a flange, (33) and (34) respectively, overlapping the edge of said cavity (41'), and furthermore limiting the rotation of said cam (2) by serving as stops for the angular part (30) which extends said cylindrical body (3) at its inner extremity, and to which the extremity of said mixing cam (2) is integrally joined.

Said screws (31) and (32) furthermore include extensions (31') and (32') which are inserted into said detection cell (5) in such a way as to prevent the rotation of said detection cell and to prevent wear on said electrical cable (50).

A mixing control handle (6) is integrally joined to said cylindrical body (3) by means of a screw (60), with said handle including a window (61) allowing the passage of rays (62).

When the use of said mixing battery (4) is desired, the issuance of water is triggered by said cell (5) when the user starts to activate said handle (6), due to the placement of his hands in the beam of said rays (62). The user can then adjust the temperature of the water to his liking by activating said handle (6).

The water flows out from inlets (47) and (48) to the openings (45') and (46') in said dummy channels (45) and (46). Then, depending on the position of said cam (2), i.e., depending on the position of said groove (20) in relation to said openings (45') and (46'), the mixture of the desired proportion of hot water and cold water is achieved in said dummy axial channel (25) and is poured into said peripheral groove (2) [sic] by means of opening (23), ending up in said outflow tank (43) until the user removes his hands from under said outflow tank (43).

With reference now to FIG. 3 and FIG. 3*a*, these figures represent an embodiment of a mixing faucet which is different from the embodiment shown in FIG. 2.

Said embodiment contains essentially the same elements shown in FIG. 2, with the difference that the outflow of water from said mixing cam (2) occurs at one of the extremities thereof by means of an oblique channel (49), with an adjustable screw (26) making it possible to limit the rotation of said cam (2).

For this purpose, said screw (26) is screwed into the body of said faucet, and the lower extremity of said screw is positioned near a flat surface (27) on said mixing cam (2). The closer said extremity is to said flat surface (27), the less hot water is provided to said opening (21) in said cam (2).

With reference now to FIG. 4*a* and FIG. 4*b*, these figures show another embodiment of a mixing faucet in accordance with the invention, intended to be attached to a wall support and to be connected to lateral water inlets.

Said embodiment includes a detection cell (5) housed in a cylindrical body (3) inserted in a cavity (41) of the body (40) of a mixing battery, with the power cable (50) of said cell (5) and the control handle (6) with its window (61) being integrally joined to said cylindrical body (3) by means of a screw (60).

The mixing cam (7), which is integrally joined to said cylindrical body (3), includes an inlet groove (71) which allows the mixing of the hot water and the cold water which arrive through two lateral conduits (72) and (73) and which pass through an opening (74) in said groove.

Said cam (7) also includes a groove (75) fitted with water outlet openings (76) and (77), such that said water flows through a channel (78) into an outflow tank (not shown).

It is obvious that the present invention is not limited to the preceding description of some of its embodiments, which can undergo a number of modifications without thereby departing from the scope of the invention. In particular, the embodiments as described for wash-basin faucets with vertical water inlets can be modified for wall faucets or for shower faucets with lateral water inlets.

We claim:

1. A faucet including an operating unit and a control unit for controlling the flow of water therefrom, said faucet comprising at least one water inlet, a water outlet opening into an outflow tank, a detection cell which utilizes rays which are emitted or received in order to activate at least one solenoid valve for automatically triggering the issuance of water from said faucet, and a cylindrical body housing said detection cell, said cylindrical body being placed within a primary cavity of said operating unit and being integrally joined to said control unit, said control unit including a window positioned facing said cylindrical body for the passage of said rays which effectuate the operation of said detection cell.

2. A faucet in accordance with claim 1, wherein said operating unit includes a secondary cylindrical cavity coextensive with said primary cavity, said faucet including a mixing cam inserted in said secondary cylindrical cavity, said cylindrical body being integrally joined with said mixing cam by means of an angular part having a cross-section in the form of an arc of a circle and a base coextensive with said cylindrical body, and including two screws screwed into said cylindrical body, each of said screws including a flange overlapping the edge of said secondary cylindrical cavity, said flanges providing stops to limit the rotation of said mixing cam, and each of said screws further including an extension penetrating into said cylindrical body so as to prevent rotation of said detection cell, said at least one water inlet comprising first and second water inlets, said first and second water inlets being parallel and orthogonal to said mixing cam.

3. A faucet in accordance with claim 2, wherein said mixing cam includes a flat surface, said faucet further comprising an adjustable screw positioned within said operating unit and facing said flat surface of said mixing cam in order to adjust an opening for the passage of hot water from one of said first and second water inlets.

4. A faucet in accordance with claim 1, wherein said water outlet opening is in fluid communication with said outflow tank, said at least one water inlet includes first and second water inlets, and said mixing cam includes a groove having an opening for the entry of hot water and cold water carried by said first and second water inlets, said mixing cam further including a groove fitted with water-outlet openings connected to said water outlet opening.

5. A faucet including an operating unit and a control unit for controlling the flow of water therefrom, said faucet comprising at least one water inlet, a water outlet opening into an outflow tank, a detection cell which utilizes rays which are emitted or received in order to activate at least one solenoid valve for automatically triggering the issuance of water from said faucet, and a cylindrical body housing said detection cell, said cylindrical body being placed within a primary cavity of said operating unit and being integrally joined to said control unit, said control unit including a window positioned facing said cylindrical body for the passage of said rays which effectuate the operation of said detection cell, said operating unit including a secondary cylindrical cavity coextensive with said primary cavity, said faucet including a mixing cam inserted in said secondary cylindrical cavity, said cylindrical body being integrally joined with said mixing cam by means of an angular part having a cross-section in the form of an arc of a circle and a base coextensive with said cylindrical body, and including two screws screwed into said cylindrical body, each of said screws including a flange overlapping the edge of said secondary cylindrical cavity, said flanges providing stops to limit the rotation of said mixing cam, and each of said screws further including an extension penetrating into said cylindrical body so as to prevent rotation of said detection cell, said at least one water inlet comprising first and second water inlets, said first and second water inlets being parallel and orthogonal to said mixing cam.

6. A faucet in accordance with claim 5, wherein said mixing cam includes a flat surface, said faucet further comprising an adjustable screw positioned within said operating unit and facing said flat surface of said mixing cam in order to adjust an opening for the passage of hot water from one of said first and second water inlets.

7. A faucet including an operating unit and a control unit for controlling the flow of water therefrom, said faucet comprising at least one water inlet, a water outlet opening into an outflow tank, a detection cell which utilizes rays which are emitted or received in order to activate at least one solenoid valve for automatically triggering the issuance of water from said faucet, and a cylindrical body housing said detection cell, said cylindrical body being placed within a primary cavity of said operating unit and being integrally joined to said control unit, said control unit including a window positioned facing said cylindrical body for the passage of said rays which effectuate the operation of said detection cell, said water outlet opening being in fluid communication with said outflow tank, said at least one water inlet including first and second water inlets, and said mixing cam including a groove having an opening for the entry of hot water and cold water carried by said first and second water inlets, said mixing cam further including a groove fitted with water-outlet openings and connected to said water outlet opening.

* * * * *